United States Patent [19]

Blomstedt

[11] 4,105,032

[45] Aug. 8, 1978

[54] PACIFIER

[75] Inventor: Hans C. M. Blomstedt, Stockholm, Sweden

[73] Assignee: Hans Blomstedt Handelsbolag, Stockholm, Sweden

[21] Appl. No.: 735,364

[22] Filed: Oct. 26, 1976

[30] Foreign Application Priority Data

Oct. 31, 1975 [SE] Sweden ..... 7512242

[51] Int. Cl.[2] ..... A61J 17/00

[52] U.S. Cl. ..... 128/360

[58] Field of Search ..... D24/45; 128/76 R, 252, 128/359, 360

[56] References Cited

U.S. PATENT DOCUMENTS

| | | | |
|---|---|---|---|
| D. 135,685 | 5/1943 | Claflin | D24/45 |
| D. 136,301 | 9/1943 | Clafin | D24/45 |
| 3,924,621 | 12/1975 | Cassimally | 128/252 |
| 3,924,638 | 12/1975 | Mann | 128/359 |

FOREIGN PATENT DOCUMENTS

| | | | |
|---|---|---|---|
| 2,320,501 | 11/1974 | Fed. Rep. of Germany | 128/76 R |
| 687,161 | 2/1953 | United Kingdom | 128/359 |

*Primary Examiner*—Robert W. Michell
*Assistant Examiner*—Arthur S. Rose
*Attorney, Agent, or Firm*—Sughrue, Rothwell, Mion, Zinn and Macpeak

[57] ABSTRACT

A spherically shaped teat is mounted to an infant pacifier shield by a unitary M-shaped support constituted by a pair of legs joined respectively to opposite sides of the shield and having its ends joined by arms to opposite sides of the teat to define a closed gap, the width of which acts to receive the incisors of the infant during infant biting of the pacifier, with the legs positioned in the bite area of the infant's side teeth.

12 Claims, 12 Drawing Figures

PACIFIER

This invention relates to a so-called dummy or pacifier having a teat, especially a spherical teat firmly attached to a shield.

Pacifiers of this known kind on the market often cause displacement of the teeth or deformation of the pallet in small children. Attempts have been made to avoid tooth displacement by flattening out the shank portion attaching the shield to the teat, which is usually made from natural rubber, with the intention that the baby will bite on the flattened shaft portion with its front teeth and thereby cause a smaller load on the front teeth. However, such an embodiment does not satisfactorily solve the problem with deformation of tooth regularity, for the reason that the front teeth of the upper jaw in a natural bite overshoot or overhang the lower jaw teeth by some millimeters. Tissues and bone structure in the baby's jaws are comparatively soft, and gradually yield to the load of relatively long duration caused by sucking a pacifier or other object preventing the front teeth from biting together in a natural way.

It is therefore a main object of the invention to provide a pacifier which prevents loading the front teeth, and moves the load to the side teeth, which are more adapted to take up loads. The crowns of the side teeth are namely directed towards each other and constitute natural stopping means during a biting movement of the jaws. The front teeth are, on the other hand, built up for a shearing or cutting function and are in a definite position relative to the side teeth, for providing the best clipping or cutting function.

The stated main object is realized according to the invention, substantially in that the teat is attached to the shield by a means of M shape, such that the load from the bite is at the side teeth.

Other objects of the invention are apparent from the following description.

Figure 2:
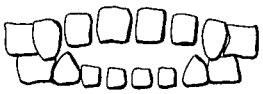
Figure 1:
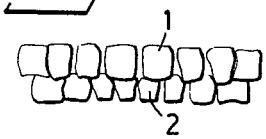
Figure 3:
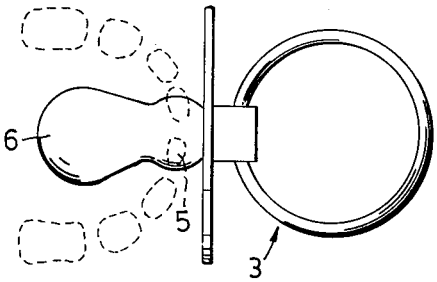
Figure 5:
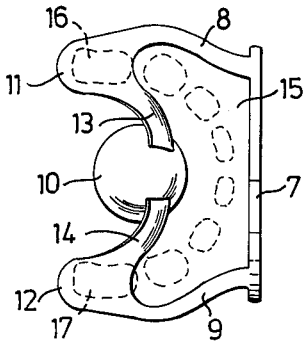
Figure 4:
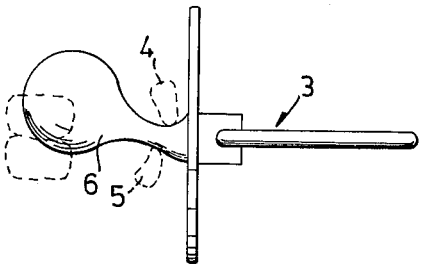
Figure 6:
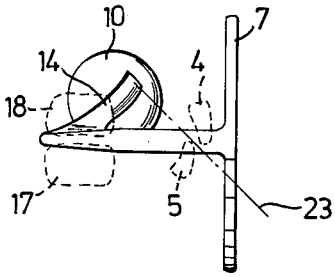
Figure 8:
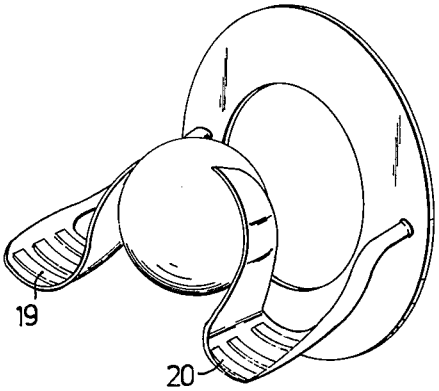
Figure 7:
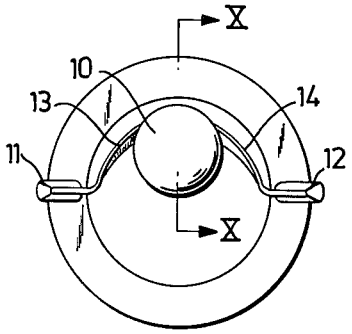
Figure 9:
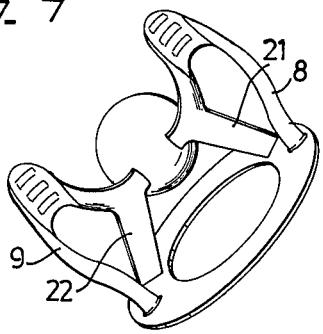
Figure 10:
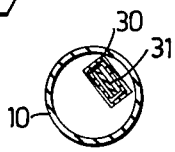
Figure 11:
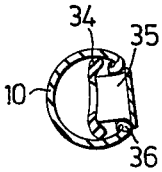
Figure 12:
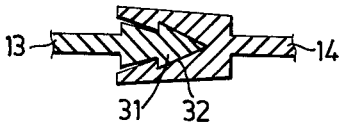

Different embodiments of the invention will now be described in conjunction with the attached drawing, on which FIG. 1 shows in a simplified manner a normal bite seen from in front, FIG. 2 shows a deformed bite caused by using an unsuitably shaped pacifier for a long time, FIG. 3 shows the idealized bite position when using a conventional pacifier, seen from above, FIG. 4 shows the pacifier according to FIG. 3 and the bite of the front teeth on the teat adjacent the shield, seen from one side, FIG. 5 shows an idealized view from above of a pacifier according to the invention, and with teeth indicated in the lower jaw, FIG. 6 shows the pacifier according to FIG. 5 seen from one side and having certain teeth indicated, FIG. 7 shows the pacifier according to FIG. 5 seen from behind, FIG. 8 shows a perspective view of a second embodiment of a pacifier according to the invention, FIG. 9 shows a third embodiment of a pacifier according to the invention, FIG. 10 is a sectional view along the line X—X in FIG. 7, FIG. 11 is a sectional view through a substantially spherical teat and shows means on the attachment means for retaining the teat, and FIG. 12 shows means for keeping the attachment means ends together in the pacifier.

FIG. 1 illustrates a normal tooth bite, the front teeth in the upper jaw, e.g. tooth 1, overshooting the front teeth in the lower jaw, e.g. the tooth 2.

FIG. 2 illustrates a heavily deformed tooth bite caused by deformation of the cheekbone from using a conventional pacifier 3 according to FIGS. 3 and 4. It is apparent from the FIGS. 3 and 4 that the front teeth 4, 5 are prevented by the teat 6 from correctly gliding over each other and thereby the teeth 4 and 5 will be exposed to relatively large compression forces, partly causing a deformation of the pallet and partly possibly causing the teeth to turn outwardly.

FIG. 4 also shows how the teat 6, which is attached to a normally circular shield, is pressed upwards by the baby's tongue (not shown) into engagement against the pallet (not shown).

The FIGS. 5, 6 and 7 show an embodiment of a pacifier according to the invention. On the shield 7, having the object of preventing the baby from completely introducing the pacifier into its mouth, there is rigidly mounted two legs 8 and 9 substantially at right angles to the shield 7. The legs 8, 9 are on either side of a spherically or hemispherically shaped teat 10, e.g. constituting a vesicle of natural rubber, artificial rubber or a suitable plastic material. From the free end portions 11 and 12 of the legs there project two arms 13 and 14, respectively, forming an integrated part of the associated leg. The legs 8, 9 and arms 13, 14 are made from a plastic material, for example, and preferably the legs 8, 9, arms 13, 14 and teat 10 form an integrated M-shaped unit made from rubber, for example. The arms 11, 12 converge towards each other and their free ends are rigidly connected to the upper part of the teat in two opposing points above the horizontal central plane of the teat. The points of attachment lie on a diameter which is parallel with the plane of the shield 7, if the shield, as is shown on the drawing, constitutes a flat disc or a flat ring. Between the legs 8, 9 and the teat 10 there is formed a free space 15 in the shown embodiment, whereby the front teeth, e.g. the front teeth 4, 5, will assume a correct biting position relative each other when the baby bites the pacifier. As is best apparent from FIG. 5, the strip-like arms 14, 15 project up from the inner edge of the flattened end portion 11, 12 of the respective leg, and the distance between said inner edges is somewhat less than the distance between the indicated side teeth 16, 17 in the lower jaw and the respective teeth corresponding thereto in the upper jaw, e.g. side tooth 18. The side teeth in the upper and lower jaws which lie against each other, e.g. side teeth 17 and 18, will thus bite against the respective end portion 11, 12 and thereby the baby's side teeth will take up the whole load. The reason for the upwardly directed arms 13, 14 being used is substantially so that the teat will be kept lifted against the pallet correspondingly to what has been described in conjunction with FIG. 4. It is quite possible to place the teat 10 centrally, however, the end portions of the legs parallel to each other curving in towards the teat to retain it.

FIG. 8 shows another embodiment of a pacifier according to the invention. What essentially distinguishes it from the embodiment according to FIGS. 5–7 is that the end portions of the legs on both the under as well as upper sides have been provided with flutings, projections or a pattern 19, 20 corresponding to the biting surface of the respective side tooth.

FIG. 9 illustrates a third embodiment substantially corresponding to the previously described embodiments, but which has been provided with reinforcing bands 21 and 22 extending from the arms or the teat, the free ends of these bands being attached to the shield 7, here shown to be annular, but which can also have other shapes, e.g. that of a disc. The angle between the reinforcing bands 21, 22 and the common plane of the legs 8, 9 is such that the bands pass between the front teeth as indicated by the dashed line 23 in FIG. 6. The bands 21, 22, which may be thread-shaped, have a small thickness so as not to be pinched between the pair-wise coacting front teeth, and are preferably not stretched.

The legs 8, 9, which suitably have a circular cross-sectional area, are formed so that they follow the jaw-bone. The attaching arms 13, 14 preferably have a rectangular section so that if they are not made integral with the teat, the teat may be attached untwistably on the arms, they also follow the shape of the pallet without making contact therewith. The teat 10 is thereby provided with a closed through-going canal 30 in which the end portions of the attaching arms are inserted. To prevent the arms being withdrawn from the teat, locking means are suitably arranged on the arms inside the teat for positively locking the arms together. FIG. 12 illustrates such locking means in a simplified manner. One attachment arm 13 is provided with teeth 31, or the like, on its end portion situated within the canal 30, the teeth coacting with corresponding teeth 32 in a recess in the end portion of the other arm 14. The ends of the closed canal 30 suitably have less area than the inserted arm portions, for positively closing around these portions. It is also possible to weld or cement the end portions of the arms to each other.

FIG. 11 illustrates in a simplified way a retaining means for a teat 10. The retaining means consists here of a ring 34 which is attached to the mutually rigidly united arms 13 and 14 by means of a projection 35. The teat 10 has an opening, and an edge 36 rolled inwards round the opening, which after the teat has been pushed over the ring 34 closes round the projection 35 and lies under the ring 34.

It is also possible to provide one of the attachment arms with an extension going through the whole of the canal 30 in the teat 10 and projecting past the second attachment arm, whereby both arms can easily be mutually rigidly attached. The attachment arms are suitably provided with flanges or stops outside the teat for preventing it gliding sideways.

It is possible, by applying known techniques, to form the whole of the pacifier in one piece using two different materials, i.e. a soft material for the teat and a harder one for the shield and possibly also for the legs and arms. It is further possible to cover the fine surface of the arms and legs with a very thin membrane if so required.

I claim:

1. In an infant pacifier including a shield having a surface, a spherically shaped teat, and means for attaching said teat to said surface of said shield, the improvement wherein said attaching means comprises a pair of legs, each having an end connected to said surface of said shield and extending from said surface generally parallel to each other in spaced relation and elongated arms joined at one end to said teat on opposite sides thereof to extend laterally from said teat and generally perpendicular to said legs and at their other end to the free end of said legs respectively and defining a closed gap with said teat and said shield whose spacing between said legs is of a width so as to be adapted to freely receive all of the incisors of an infant during biting of said pacifier with the portions of said legs adjacent said arms falling in the bite area of an infant's side teeth.

2. A pacifier as claimed in claim 1, characterized in that the shield is shaped as a ring.

3. A pacifier as claimed in claim 1, wherein said teat and said arms and legs are made in one piece.

4. A pacifier as claimed in claim 1, wherein said legs define a plane therebetween and said arms are inclined relative to said plane.

5. A pacifier as claimed in claim 4, wherein said teat defines a canal and said arms have end portions inserted within said canal.

6. A pacifier as claimed in claim 5, wherein the end portions of the arms inserted in the canal are united with each other.

7. A pacifier as claimed in claim 6, wherein said end portions comprise complementary locking means and said end portions are united with each other by said complementary locking means.

8. A pacifier as claimed in claim 1, wherein the end portions of the legs where they join the arms are formed as substantially flat, thin sheets for contact with an infant's side teeth.

9. A pacifier as claimed in claim 8, wherein the flat, thin sheets on either side have a raised pattern.

10. A pacifier as claimed in claim 1, further comprising thin bands having an end attached to the arms adjacent the teat and having their other end attached to the shield at a distance from the attachment points of the legs to said shield.

11. A pacifier as claimed in claim 10, wherein the bands are unstretched.

12. A pacifier as claimed in claim 1, wherein said teat has an opening therein, said arms are joined together by a ring means, and said ring means bears a flange, said flange being enclosed by the edges of said opening in said teat.

* * * * *